US009734794B2

(12) United States Patent
Woo

(10) Patent No.: US 9,734,794 B2
(45) Date of Patent: Aug. 15, 2017

(54) DEVICE AND METHOD FOR DRIVING LIQUID CRYSTAL DISPLAY

(71) Applicant: Samsung Display Co., Ltd., Yongin (KR)

(72) Inventor: Hwa Sung Woo, Asan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 576 days.

(21) Appl. No.: 14/296,111

(22) Filed: Jun. 4, 2014

(65) Prior Publication Data

US 2015/0154930 A1 Jun. 4, 2015

(30) Foreign Application Priority Data

Dec. 4, 2013 (KR) ..... 10-2013-0150085

(51) Int. Cl.
*G09G 5/10* (2006.01)
*G09G 3/36* (2006.01)

(52) U.S. Cl.
CPC ..... *G09G 5/10* (2013.01); *G09G 3/3648* (2013.01); *G09G 2320/0219* (2013.01)

(58) Field of Classification Search
CPC . G09G 5/10; G09G 3/3648; G09G 2320/0219
See application file for complete search history.

(56) References Cited

U.S. PATENT DOCUMENTS 6,063,829 A 5/2000 Endou et al.
7,768,489 B2 * 8/2010 Liu ..... G09G 3/3648 345/204
8,125,433 B2 2/2012 Song et al.
2008/0094334 A1 * 4/2008 Baek ..... G09G 3/3677 345/89
2009/0195566 A1 * 8/2009 Miyazaki ..... G09G 3/3446 345/690
2012/0098818 A1 4/2012 Yoon
(Continued)

FOREIGN PATENT DOCUMENTS

JP 3893659 12/2006
JP 4504665 4/2010
(Continued)

*Primary Examiner* — Lun-Yi Lao
*Assistant Examiner* — Kelly Hegarty
(74) *Attorney, Agent, or Firm* — Cantor Colburn LLP

(57) ABSTRACT

A device for driving a liquid crystal display, in which a pixel voltage is reduced by a kickback voltage variable according to grayscales, includes: a signal controller which receives an input image signal corresponding to a grayscale; an image signal corrector which corrects the input image signal and generates a data input signal; and a data driver which supplies a data voltage corresponding to the grayscale based on the data input signal, where the grayscale includes black, white grayscale and intermediate grayscales, the data voltage includes positive and negative voltages, and when a difference between a sum of the positive and negative voltages and a common voltage is defined an offset value, a first offset value corresponding to the black grayscale, a second offset value corresponding to the white grayscale and a third offset value corresponding to the intermediate grayscale satisfy the inequation: |first offset value−second offset value|≤50 mV.

14 Claims, 11 Drawing Sheets

(56) References Cited

U.S. PATENT DOCUMENTS

| | | | | |
|---|---|---|---|---|
| 2013/0135330 | A1* | 5/2013 | Choi | G09G 3/3648 345/545 |
| 2014/0104155 | A1* | 4/2014 | Long | G09G 3/344 345/107 |
| 2015/0243229 | A1* | 8/2015 | Jung | G09G 3/3688 345/690 |
| 2016/0189651 | A1* | 6/2016 | Jung | G09G 3/3655 345/101 |

FOREIGN PATENT DOCUMENTS

| | | |
|---|---|---|
| JP | 5085602 | 9/2012 |
| KR | 10-2007-0098365 | 10/2007 |
| KR | 10-2009-0055094 | 6/2009 |

* cited by examiner

FIG. 7

| Driving conditions | Afterimage estimation (12G) | Etc. |
|---|---|---|
| | One-hour eye -viewing degree | |
| Woff+0, Boff+0, Goff, i+0 | 3.5 | Split with same absolute value between Woff and Boff |
| Woff+50, Boff+50, Goff, i+0 | 3.5 | |
| Woff+100, Boff+100, Goff, i+0 | 3.5 | |
| Woff-50, Boff-50, Goff, i+0 | 3.5 | |
| Woff-100, Boff-100, Goff, i+0 | 3.5 | |
| Woff+0, Boff+50, Goff, i+0 | 4.0 | Split with different absolute values between Woff and Boff |
| Woff+50, Boff+0, Goff, i+0 | 4.0 | |
| Woff+0, Boff+20, Goff, i+0 | 3.5 | |
| Woff+20, Boff+0, Goff, i+0 | 3.5 | |
| Woff+0, Boff+10, Goff, i+0 | 3.5 | Optimization of difference between Woff and Boff |
| Woff+0, Boff+5, Goff, i+0 | 3.0 | |

FIG. 9

| Driving conditions | Afterimage estimation (12G) | | Etc. |
|---|---|---|---|
| | One-hour eye-viewing degree | 5-min release | |
| Woff+0, Boff+5, Goff, i+0 | 3.0 | 3.0 | Split of release characteristic according to Goff and i |
| Woff+0, Boff+5, Goff, i+20 | 3.0 | 2.5 | |
| Woff+0, Boff+5, Goff, i+50 | 3.0 | 2.0 | |
| Woff+0, Boff+5, Goff, i-20 | 3.0 | 2.5 | |
| Woff+0, Boff+5, Goff, i-50 | 3.0 | 2.0 | |
| Woff+50, Boff+50, Goff, i+50 | 3.5 | 3.5 | Split according to relative value |
| Woff+0, Boff+0, Goff, i+0 | 3.5 | 3.5 | |

FIG. 11

| Test items | Test conditions | Cell ID | Image quantization | | | | |
|---|---|---|---|---|---|---|---|
| | | | 8 Gray | 12 Gray | 18 Gray | 26 Gray | 33 Gray |
| Afterimage | 60-deg. 1-hr 5x8 mosaic pattern | #1 | 1 | 1 | 0 | 0 | 0 |
| | | #2 | 1 | 1 | 1 | 1 | 1 |
| | | #3 | 2 | 1 | 1 | 1 | 1 |
| | | #4 | 2 | 2 | 1 | 1 | 1 |

DEVICE AND METHOD FOR DRIVING LIQUID CRYSTAL DISPLAY

This application claims priority to Korean Patent Application No. 10-2013-0150085, filed on Dec. 4, 2013, and all the benefits accruing therefrom under 35 U.S.C. §S.C. the content of which in its entirety is herein incorporated by reference.

BACKGROUND (a) Field

Exemplary embodiments of the invention relate to a device and method for driving a liquid crystal display.

(b) Description of the Related Art

A liquid crystal display, which is one of the most widely used types of flat panel display, typically includes two display panels, in which field generating electrodes such as a pixel electrode and a common electrode are provided, and a liquid crystal layer interposed between the two display panels.

The liquid crystal display applies a voltage to the field generating electrodes to generate an electric field in the liquid crystal layer, determine alignment of liquid crystal molecules of the liquid crystal layer by the electric field, and control the polarization of incident light to display an image.

The liquid crystal display includes a thin film transistor, a gate line and a data line provided on a display panel of the liquid crystal display including the thin film transistor, and a pixel corresponding to a region for displaying a screen connected to the thin film transistor.

When a gate-on voltage is applied to the gate line and the thin film transistor of a pixel connected to the gate line is thereby turned on, a data voltage applied through the data line is charged in the pixel. In the liquid crystal display, the alignment of the liquid crystal molecules in the liquid crystal layer is determined by an electric field generated by a pixel voltage charged in the pixel and a common voltage applied to a common electrode. The data voltage may be applied with different polarities for each frame.

The data voltage applied to the pixel is reduced by parasitic capacitance between a gate electrode and a source electrode, and the reduced data voltage becomes a pixel voltage. A voltage difference between the data voltage and the pixel voltage will be referred to as a kickback voltage.

The kickback voltage is changed based on a grayscale level and a polarity of the data voltage, and changes the pixel voltage for each frame. Accordingly, a flicker caused by a luminance difference may be observed, and the liquid crystal layer may be influenced by a residual direct current ("DC") voltage to generate an afterimage.

SUMMARY

Exemplary embodiments of the invention relate to a device and method for driving a liquid crystal display for reducing visibility of an afterimage.

An exemplary embodiment of the invention provides a device for driving a liquid crystal display, in which a pixel voltage is reduced by a kickback voltage variable according to a grayscale, the device including: a signal controller configured to receive an input image signal corresponding to the grayscale from outside; an image signal corrector configured to correct the input image signal and generate a data input signal based on the corrected input image signal; and a data driver configured to supply a data voltage corresponding to the grayscale based on the data input signal, where the grayscale includes a black grayscale, a white grayscale, and an intermediate grayscale between the black grayscale and the white grayscale, the data voltage includes a positive voltage and a negative voltage, and when a difference between a sum of the positive voltage and the negative voltage, and a common voltage, is defined as an offset value, a first offset value corresponding to the black grayscale, a second offset value corresponding to the white grayscale, and a third offset value corresponding to the intermediate grayscale satisfy the following inequation: |first offset value−second offset value|≤50 millivolts (mV).

In an exemplary embodiment, the first offset value corresponding to the black grayscale, the second offset value corresponding to the white grayscale and the third offset value corresponding to the intermediate grayscale may satisfy the following inequation: Max (|third offset value−first offset value|, |third offset value−second offset value|)≥20 mV.

In an exemplary embodiment, the liquid crystal display may include: a first substrate; a thin film transistor provided on the first substrate; a first electrode connected to the thin film transistor; and a first alignment layer provided on the first electrode, where the first alignment layer may include a polymer formed using at least one of a cyclobutane dianhydride ("CBDA") and a CBDA derivative.

In an exemplary embodiment, the CBDA may be expressed as Formula (A), and the CBDA derivative may be expressed as Formula (B):

Formula (A)

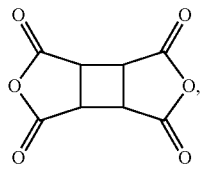

Formula (B)

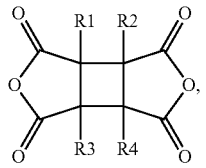

where R1, R2, R3 and R4 are independently hydrogen or an organic compound, and at least one of R1, R2, R3 and R4 is not hydrogen. The organic compound may be a C1 to C18 alkyl group, a C2 to C18 alkenyl group, a C6 to C12 aryl group, or a combination thereof.

In an exemplary embodiment, the liquid crystal display may further include a second electrode disposed on the first substrate, and an insulating layer disposed between the first electrode and the second electrode, where the first electrode may include a plurality of branch electrodes, and the second electrode may have a planar shape.

In an exemplary embodiment, the plurality of branch electrodes may overlap the second electrode having the planar shape.

In an exemplary embodiment, the liquid crystal display may further include a passivation layer disposed between the thin film transistor and the second electrode, and the thin film transistor may be connected to the first electrode through a contact hole defined through the passivation layer and the insulating layer.

Another exemplary embodiment of the invention provides a method for driving a liquid crystal display, in which a pixel voltage is reduced by a kickback voltage variable according to a grayscale, the method including: receiving an input image signal from outside; and correcting the input image signal and generating a data input signal based on the corrected input image signal, where a data voltage corresponding to the grayscale includes a black data voltage corresponding to a black grayscale, a white data voltage corresponding to a white grayscale, and an intermediate data voltage corresponding to an intermediate grayscale between the black grayscale and the white grayscale, the data voltage further includes a positive voltage and a negative voltage, and when a difference between a sum of the positive voltage and the negative voltage, and a common voltage, is defined as an offset value, a first offset value corresponding to the black grayscale, a second offset value corresponding to the white grayscale, and a third offset value corresponding to the intermediate grayscale satisfy the following inequation: |first offset value−second offset value|≤50 mV.

In an exemplary embodiment, the first offset value corresponding to the black grayscale, the second offset value corresponding to the white grayscale and the third offset value corresponding to the intermediate grayscale may satisfy the following inequation: Max (|third offset value−first offset value|, |third offset value−second offset value|)≥20 mV.

In an exemplary embodiment, the liquid crystal display may include: a first substrate; a thin film transistor disposed on the first substrate; a first electrode connected to the thin film transistor; and a first alignment layer disposed on the first electrode, where the first alignment layer may include a polymer formed using at least one of a CBDA and a CBDA derivative.

In an exemplary embodiment, the CBDA may be expressed as Formula (A), and a CBDA derivative may be expressed as Formula (B):

Formula (A)

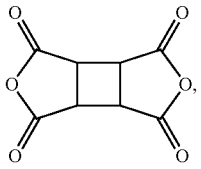

Formula (B)

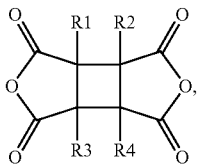

where R1, R2, R3 and R4 are independently hydrogen or an organic compound, and at least one of R1, R2, R3 and R4 is not hydrogen. The organic compound may be a C1 to C18 alkyl group, a C2 to C18 alkenyl group, a C6 to C12 aryl group, or a combination thereof.

In an exemplary embodiment, the liquid crystal display may further include a second electrode disposed on the first substrate, and an insulating layer disposed between the first electrode and the second electrode, where the first electrode may include a plurality of branch electrodes, and the second electrode may have a planar shape.

In an exemplary embodiment, the plurality of branch electrodes may overlap the second electrode having the planar shape.

In an exemplary embodiment, the liquid crystal display may further include a passivation layer provided between the thin film transistor and the second electrode, and the thin film transistor may be connected to the first electrode through a contact hole defined through the passivation layer and the insulating layer.

According to exemplary embodiments of the invention, the visibility of the afterimage may be reduced by controlling a difference between an offset amount that corresponds to a black grayscale and an offset amount that corresponds to a white grayscale to be less than a predetermined value. In such embodiments, the visibility of the afterimage may be reduced by controlling a difference between an offset amount of an intermediate grayscale except the white grayscale and the black grayscale and an offset amount of the white grayscale or the offset amount of the black grayscale to be greater than a predetermined value.

BRIEF DESCRIPTION OF THE DRAWINGS

The above and other features of the invention will become more apparent by describing in detailed exemplary embodiments thereof with reference to the accompanying drawings, in which:

FIG. 7 is a table showing afterimage estimation performed under various conditions for driving a liquid crystal display;

FIG. 9 is a table showing afterimage estimation performed under a condition for driving a liquid crystal display;

FIG. 11 is a table showing afterimage estimation by applying a device and method for driving a liquid crystal display, according to the invention.

DETAILED DESCRIPTION

Figure 1:
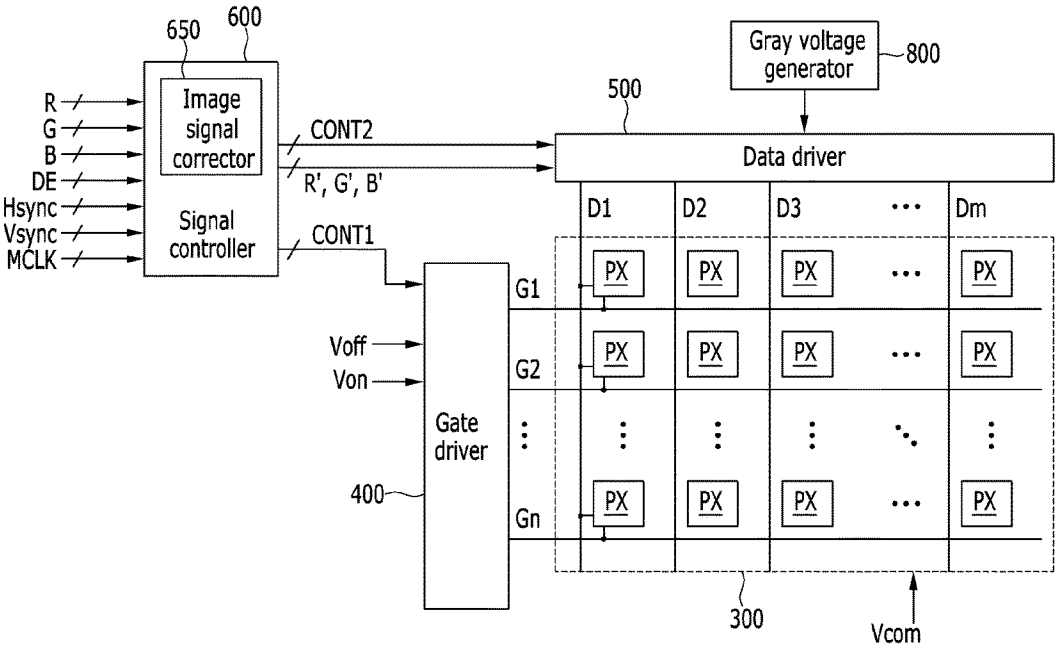
FIG. 1 is a block diagram showing an exemplary embodiment of a liquid crystal display, according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, exemplary embodiments of the invention will be described in further detail with reference to the accompanying drawings.

Figure 2:
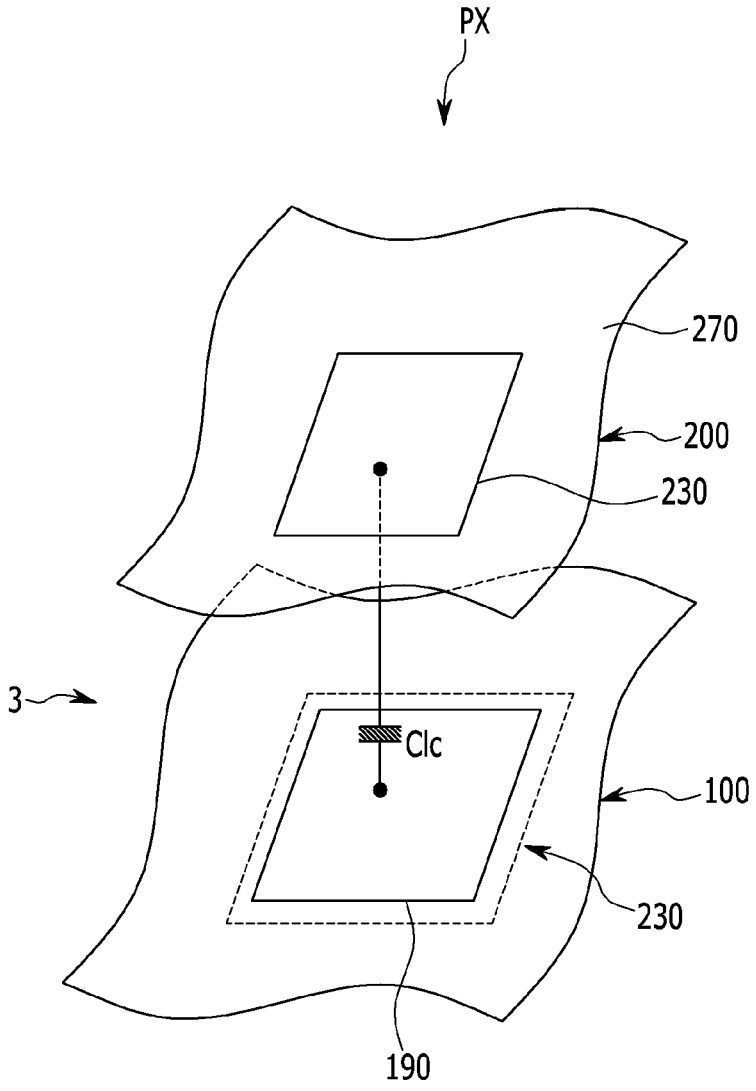
FIG. 2 is an equivalent circuit diagram of a pixel in an exemplary embodiment of a liquid crystal display, according to the invention.

FIG. 1 shows a block diagram showing an exemplary embodiment of a liquid crystal display according to the invention, and FIG. 2 shows an equivalent circuit diagram of a pixel in an exemplary embodiment of a liquid crystal display according to the invention.

Referring to FIG. 1, an exemplary embodiment of a liquid crystal display includes a liquid crystal panel assembly 300, a gate driver 400, a data driver 500, a gray voltage generator 800 and a signal controller 600. The signal controller 600 includes an image signal corrector 650.

Referring to FIG. 1, the liquid crystal panel assembly 300 includes a plurality of signal lines ($G_1$-$G_n$, $D_1$-$D_m$) and a plurality of pixels (PX) connected to the signal lines ($G_1$-$G_n$, $D_1$-$D_m$) and arranged substantially in a matrix form in an equivalent circuit manner. In an exemplary embodiment, as shown in FIG. 2, the liquid crystal panel assembly 300 includes lower and upper panels 100 and 200, which are disposed opposite to each other, and a liquid crystal layer 3 disposed between the lower and upper panels 100 and 200.

The signal lines ($G_1$-$G_n$, $D_1$-$D_m$) include a plurality of gate lines ($G_1$-$G_n$) for transmitting a gate signal (also referred to as a scanning signal) and a plurality of data lines ($D_1$-$D_m$) for transmitting a data voltage. The gate lines ($G_1$-$G_n$) extend substantially in a pixel row direction and are disposed substantially parallel to each other, and the data lines ($D_1$-$D_m$) extend substantially in a pixel column direction and are disposed parallel to each other.

In one exemplary embodiment, for example, the pixel (PX) connected to an i-th (i=1, 2, . . . , n) gate line ($G_i$) and a j-th (j=1, 2, . . . , m) data line ($D_j$) includes a switch connected to the signal lines ($G_i$, $D_j$), a liquid crystal capacitor (Clc) connected to the switch, and a storage capacitor (Cst). In an alternative exemplary embodiment, the storage capacitor may be omitted.

The switch may be a three-terminal element, such as a thin film transistor, disposed in the lower panel 100, a control terminal of the switch is connected to the gate line ($G_i$), an input terminal of the switch is connected to the data line ($D_j$), and an output terminal of the switch is connected to the liquid crystal capacitor (Clc) and the storage capacitor.

The liquid crystal capacitor (Clc) is defined by a pixel electrode 190 of the lower panel 100 and a common electrode 270 of the upper panel 200 as two terminals, and the liquid crystal layer 3 between the electrodes 191 and 270 functions as a dielectric material. The pixel electrode 190 is connected to the switch, and the common electrode 270 is disposed on a front side of the upper panel 200 and receives a common voltage (Vcom). In an alternative exemplary embodiment, the common electrode 270 may be disposed in the lower panel 100, and at least one of the electrodes 191 and 270 may have a linear shape or a bar shape.

In an exemplary embodiment, the storage capacitor that supports the liquid crystal capacitor (Clc) may be formed by overlapping an additional signal line (not shown) disposed in the lower panel 100 and the pixel electrode 190 with an insulator therebetween, and a predetermined voltage such as the common voltage (Vcom) is applied to the signal line. In an alternative exemplary embodiment, the storage capacitor may be formed by overlapping the pixel electrode 190 and a previous gate line $G_{i-1}$ with an insulator as a medium.

In an exemplary embodiment, each pixel (PX) may express one of primary colors (e.g., a spatial division) or may alternately express the primary colors with respect to time (e.g., a temporal division) to realize color expression such that a desired color may be recognized by a spatial or temporal sum of the primary colors. In one exemplary embodiment, for example, the primary colors include red, green and blue. In an exemplary embodiment, as shown in FIG. 2 each pixel (PX) may include a color filter 230 for expressing one of the primary colors in a region of the lower panel 100 that corresponds to the pixel electrode 190. In an exemplary embodiment, the color filter 230 may include an organic insulator.

The liquid crystal panel assembly 300 includes a polarizer (not shown).

Hereinafter, an exemplary embodiment of a liquid crystal panel assembly 300 of a liquid crystal display, according to the invention, will now be described with reference to FIG. 3 and FIG. 4. In such an embodiment, the common electrode 270 is disposed in the lower panel 100.

Figure 3:
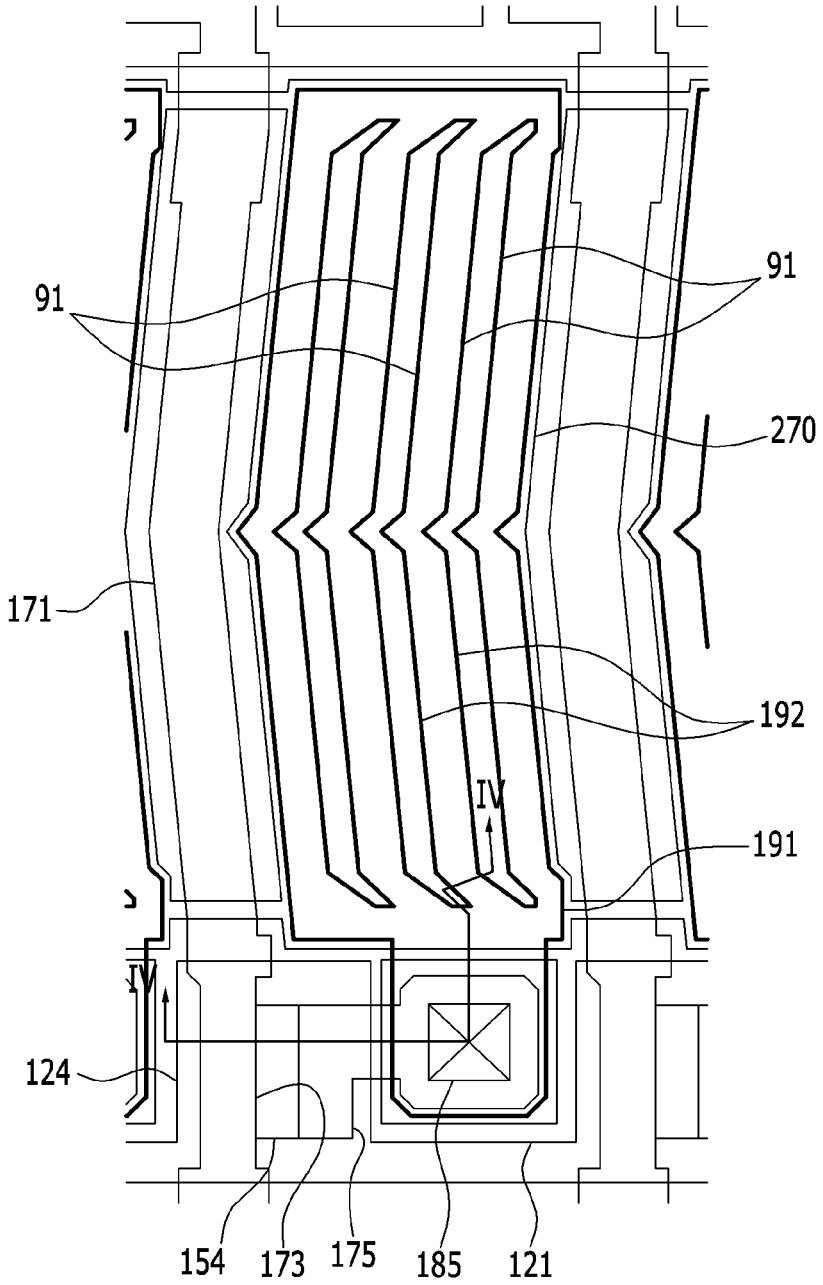
FIG. 3 is a top plan view of an exemplary embodiment of a liquid crystal display, according to the invention.

FIG. 3 is a top plan view of an exemplary embodiment of a liquid crystal display, according to the invention. FIG. 4 is a cross-sectional view taken along line IV-IV of FIG. 3.

Figure 4:
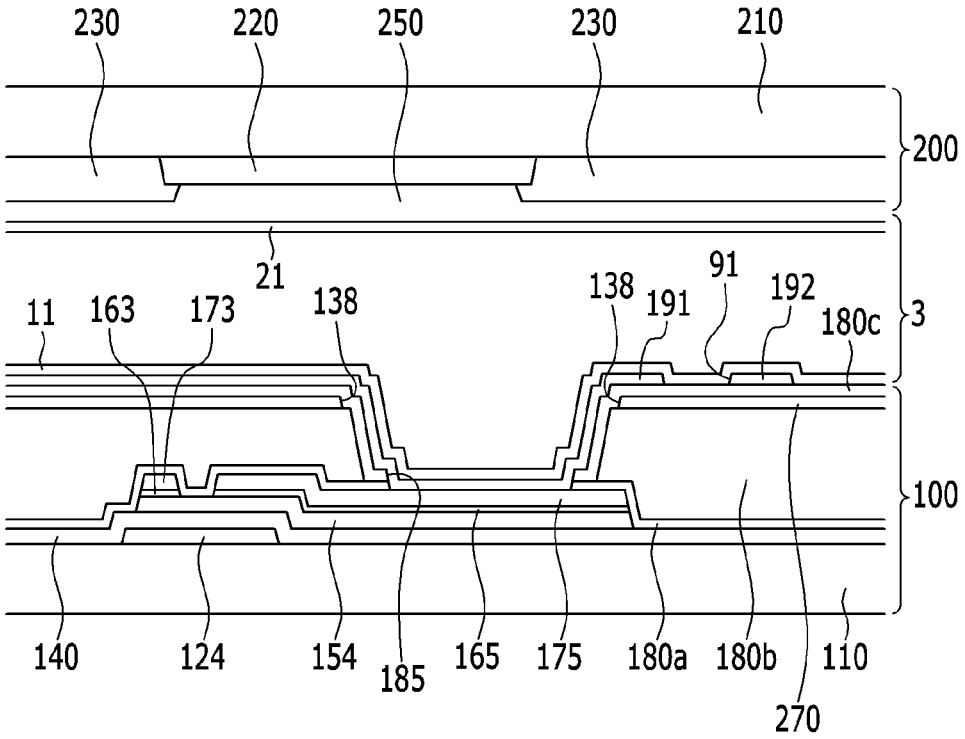
FIG. 4 is a cross-sectional view taken along line IV-IV of FIG. 3.

Referring to FIG. 3 and FIG. 4, an exemplary embodiment of the liquid crystal display includes a lower panel 100 and an upper panel 200, which are disposed opposite to each other, and a liquid crystal layer 3 disposed between the lower and upper panels 100 and 200.

The lower panel 100 will now be described in detail.

In an exemplary embodiment, the lower panel 100 includes a first substrate 110 including a transparent material, e.g., glass or plastic. In such an embodiment, a gate conductor including a gate line 121 is disposed on the first substrate 110. The gate line 121 may extend substantially in a horizontal direction.

The gate line 121 includes a gate electrode 124 and an end portion (not shown) for connection with another layer or an external driving circuit. The gate line 121 may include or be made of aluminum (Al) or an aluminum-based metal such as an aluminum alloy, silver (Ag) or a silver-based metal such as a silver alloy, copper (Cu) or a copper-based metal such as a copper alloy, molybdenum (Mo) or a molybdenum-based metal such as a molybdenum alloy, chromium (Cr), tantalum (Ta), titanium (Ti), or a combination thereof. In an exemplary embodiment, the gate line 121 may have a multilayer structure including at least two conductive layers having different physical properties.

A gate insulating layer 140 including a silicon nitride (SiNx) or a silicon oxide (SiOx) is disposed on the gate line 121. The gate insulating layer 140 may have a multilayer structure including at least two insulating layers having different physical properties.

A semiconductor layer 154 including amorphous silicon or polysilicon is disposed on the gate insulating layer 140. The semiconductor layer 154 may include an oxide semiconductor.

Ohmic contacts 163 and 165 are disposed on the semiconductor layer 154. The ohmic contacts 163 and 165 may include or be made of a material such as n+hydrogenated amorphous silicon, on which an n-type impurity such as phosphorus is doped at a high concentration, or a silicide. The ohmic contacts 163 and 165 may be disposed as a pair on the semiconductor layer 154. In an exemplary embodiment, the semiconductor layer 154 may be an oxide semiconductor, and the ohmic contacts 163 and 165 may be omitted.

A data conductor including a data line 171 including a source electrode 173 and a drain electrode 175 is disposed on the ohmic contacts 163 and 165 and the gate insulating layer 140.

The data line 171 includes a wide end portion (not illustrated) for connection with another layer or an external driving circuit. The data line 171 transmits a data signal and extends substantially in a vertical direction, thereby crossing the gate line 121.

The data line 171 may include a first curved portion having a curved shape to obtain maximum transmittance of the liquid crystal display, and first curved portions may meet each other at a middle region of a pixel area to form a V-like shape. A second curved portion, which is curved to form a predetermined angle with the first curved portion, may be further included in the data line 171 at the middle region of the pixel area.

The source electrode 173 corresponds to a part of the data line 171, and is disposed on a same line as the data line 171. The drain electrode 175 extends substantially parallel to the source electrode 173. Therefore, the drain electrode 175 is parallel to a part of the data line 171.

The gate electrode 124, the source electrode 173 and the drain electrode 175 collectively define a thin film transistor ("TFT") together with the semiconductor 154, and a channel of the thin film transistor is formed in the semiconductor 154 between the source electrode 173 and the drain electrode 175.

In an exemplary embodiment, the liquid crystal display includes the source electrode 173 disposed on the same line as the data line 171 and the drain electrode 175 extending substantially parallel to the data line 171 such that the width of the thin film transistor may be increased without increasing an area of the data conductor, thereby increasing the aperture ratio of the liquid crystal display.

The data line 171 and the drain electrode 175 may include or be made of a refractory metal such as molybdenum, chromium, tantalum, and titanium, or an alloy thereof, and have a multilayer structure including a refractory metal layer (not shown) and a low resistance conductive layer (not shown). In one exemplary embodiment, for example, the data line 171 having the multilayer structure include a double layer including a chromium or molybdenum (alloy) lower layer and an aluminum (alloy) upper layer, or a triple layer including a molybdenum (alloy) lower layer, an aluminum (alloy) intermediate layer and a molybdenum (alloy) upper layer.

A first passivation layer **180*a* is disposed on the data conductors 171, 173 and 175, the gate insulating layer 140 and the exposed portion of the semiconductor 154. The first passivation layer 180*a*** may include or be made of an organic insulating material or an inorganic insulating material.

A second passivation layer 180*b* is disposed on the first passivation layer 180*a*. The second passivation layer 180*b* may include or be made of the organic insulator.

In an exemplary embodiment, the second passivation layer 180*b* may be a color filter. In such an embodiment, where the second passivation layer 180*b* is the color filter, the second passivation layer 180*b* may display one of primary colors, e.g., three primary colors such as red, green and blue, or yellow, cyan and magenta. In an alternative exemplary embodiment, the color filter may be a color filter for displaying a mixed color of the primary colors or white, other than the primary colors. In such an embodiment, where the second passivation layer 180*b* is the color filter, the color filter 230 disposed in the upper panel 200 as shown in FIG. 4, may be omitted.

A common electrode 270 is disposed on the second passivation layer 180*b*. The common electrode 270 has a planar shape (e.g., a plate shape), and may cover substantially an entire upper surface of the first substrate 110. In such an embodiment, an opening 138 may be defined through the common electrode 270 in the region corresponding to the periphery of the drain electrode 175.

Common electrodes 270 disposed in adjacent pixels are connected to each other to receive a common voltage of a predetermined level supplied from outside of the display area.

An insulating layer 180*c* is disposed on the common electrode 270. The insulating layer 180*c* may include or be made of an organic insulating material or an inorganic insulating material.

A pixel electrode 191 is disposed on the insulating layer 180*c*. The pixel electrode 191 includes a curved edge which is substantially parallel to the first curved portion and the second curved portion of the data line 171. A plurality of cutouts 91 is defined in the pixel electrode 191, and the pixel electrode 191 includes a plurality of branch electrodes 192 defined between neighboring cutouts 91.

The pixel electrode 191 may be referred to as a first field generating electrode or a first electrode, and the common electrode 270 may be referred to as a second field generating electrode or a second electrode. The pixel electrode 191 and the common electrode 270 may be configured to generate a horizontal electric field.

A first contact hole 185 for exposing the drain electrode 175 is defined through the first passivation layer 180*a*, the second passivation layer 180*b* and the insulating layer 180*c*. The pixel electrode 191 is physically and electrically connected to the drain electrode 175 through the first contact hole 185 to receive a voltage from the drain electrode 175.

A first alignment layer 11 is disposed on the pixel electrode 191 and the insulating layer 180*c*

In an exemplary embodiment, the first alignment layer 11 includes a photoreactive material.

The first alignment layer 11 includes a polymer. In an exemplary embodiment, the first alignment layer 11 may be formed by polymerizing at least one of a cyclobutane dianhydride ("CBDA") and a CBDA derivative. In such an embodiment, an liquid crystal photoalignment agent including the polymer of at least one of the CBDA and the CBDA derivative may be formed by a polymerization (e.g., an addition polymerization) of at least one of the CBDA expressed by Formula (A) and the CBDA derivative expressed by Formula (B) with a diamine.

Formula (A)

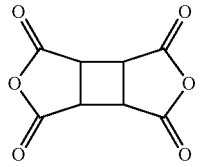

Formula (B)

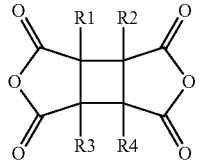

Here, in Formula (B), R1, R2, R3 and R4 are each independently hydrogen, fluoride, or an organic compound, and at least one of R1, R2, R3 and R4 is not hydrogen. The organic compound may be a C1 to C18 alkyl group, a C2 to C18 alkenyl group, a C6 to C12 aryl group, or a combination thereof.

The diamine may be an aromatic diamine such as p-phenylenediamine, m-phenylenediamine, 2,5-diaminotoluene, 2,6-diaminotoluene, 4,4'-diaminobiphenyl, 3,3'-dimethyl-4,4'-diaminobiphenyl, 3,3'-dimethoxy-4,4'-diaminobiphenyl, diaminodiphenylmethane, diaminodiphenylether, 2,2'-diaminodiphenylpropane, bis(3,5-diethyl4-aminophenyl) methane, diaminodiphenyl sulfone, diaminobenzophenone, diaminonaphthalene, 1,4-bis(4-aminophenoxy)benzene, 1,4-bis(4-aminophenyl)benzene, 9,10-bis(4-aminophenyl) anthracene, 1,3-bis(4-aminophenoxy)benzene, 4,4'-bis(4-aminophenoxy)diphenylsulfone, 2,2-bis[4-(4-aminophenoxy)phenyl]propane, 2,2-bis(4-aminophenyl) hexafluoropropane and 2,2-bis[4-(4-aminophenoxy)phenyl] hexafluoropropane, an alicyclic diamine such as bis(4-aminocyclohexyl)methane and bis(4-amino-3-methylcyclohexyl)methane, or an aliphatic diamine such as tetramethylenediamine and hexamethylenediamine, however the invention is not limited thereto.

The liquid crystal photoalignment agent may include a repeating unit expressed by Formula (C) or Formula (D).

Formula (C)

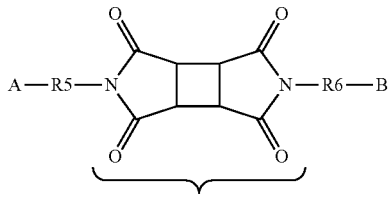

Formula (D)

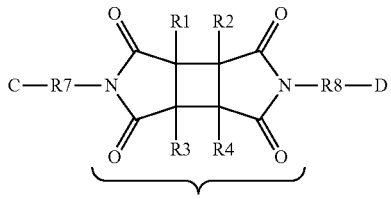

Here, in Formula (C) and Formula (D), R5, R6, R7 and R8 may each be a body coupled to two amino groups (—NH2) in a diamine, and A, B, C and D may each be unit 1 or unit 2.

Hereinafter, an exemplary embodiment of a method for forming the alignment layer will now be described.

In an exemplary embodiment, the photoalignment agent formed by polymerizing at least one of the CBDA and the CBDA derivative is coated on the pixel electrode 191. Then, the coated photoalignment agent is baked. The baking may be performed through two steps of a pre-bake and a hard bake.

The light polarized to the photoalignment agent is irradiated to form the first alignment layer 11. At this time, the irradiated light may be ultraviolet rays in a wavelength range of about 240 nanometers (nm) to about 380 nm. In one exemplary embodiment, for example, ultraviolet rays having a wavelength of about 254 nm may be used. In an exemplary embodiment, the first alignment layer 11 may be baked one more time to increase the alignment characteristic.

Hereinafter, the upper panel 200 will now be described.

The upper panel 200 includes a second substrate including a transparent material, e.g., glass or plastic. A light blocking member 220 is disposed on the second substrate 210. The light blocking member 220 blocks light leakage, and may be referred to as a black matrix.

In an exemplary embodiment, as shown in FIG. 4, a plurality of color filters 230 is disposed on the second substrate 210. In an alternative exemplary embodiment, where the second passivation layer 180*b* of the lower panel 100 is a color filter, the color filter 230 of the upper panel 200 may be omitted. In such an embodiment, the light blocking member 220 of the upper panel 200 may also be disposed in the lower panel 100.

An overcoat 250 is disposed on the color filter 230 and the light blocking member 220. The overcoat 250 may include or be made of an (organic) insulator, effectively prevent the color filter 230 from being exposed, and provide a flat surface. In an alternative exemplary embodiment, the overcoat 250 may be omitted.

A second alignment layer 21 is disposed on the overcoat 250. The second alignment layer 21 includes a photoreactive material. The second alignment layer 21 may include or be formed of the same material and by the same method as the first alignment layer 11 described above.

The liquid crystal layer 3 may include a liquid crystal material having positive dielectric anisotropy.

Liquid crystal molecules of the liquid crystal layer 3 may be aligned in a predetermined direction such that longitudinal axes thereof are substantially parallel to the surfaces of the display panels 100 and 200.

The pixel electrode 191 receives the data voltage from the drain electrode 175, and the common electrode 270 receives the common voltage of a predetermined level from a common voltage application unit (not shown) disposed outside the display area.

The pixel electrode 191 and the common electrode 270 as field generating electrodes generate an electrical field in the liquid crystal layer 3 such that the liquid crystal molecules of the liquid crystal layer 3 disposed therebetween are rotated in a direction substantially parallel to the direction of the electric field. As described above, the polarization of light passing through the liquid crystal layer is changed according to the determined rotation direction of the liquid crystal molecules.

As described above, in an exemplary embodiment, the two field generating electrodes 191 and 270 are disposed in a same display panel, e.g., the lower panel 100, such that transmittance of the liquid crystal display is increased and a wide viewing angle may be realized.

According to an exemplary embodiment of the liquid crystal display, the common electrode 270 has the planar shape and the pixel electrode 191 has a plurality of branch electrodes. In an alternative exemplary embodiment, however, the pixel electrode 191 may have a planar shape and the common electrode 270 may have a plurality of branch electrodes.

In such an embodiment of the invention, two field generating electrodes overlap each other via the insulating layer on the first substrate 110, a first field generating electrode under the insulating layer among the two field generating electrodes may have the plane shape, and a second field generating electrode on the insulating layer among the two field generating electrodes may have a plurality of branch electrodes.

An exemplary embodiment of driving devices for driving a liquid crystal display, according to the invention, will now be described.

Referring to FIG. 1, the gray voltage generator 800 generates all gray voltages corresponding to all grayscale levels to be displayed by the pixel PX in the display panel assembly 300 or a predetermined number of gray voltages, a number of which may be less than the number of the all gray voltages. The gray voltages may include voltages having a positive value and a negative value with respect to the common voltage (Vcom).

The gate driver 400 is connected to the gate lines ($G_1$-$G_n$) of the liquid crystal panel assembly 300 and applies a gate signal that is a combination of a gate-on voltage (Von) and a gate-off voltage (Voff) to the gate lines ($G_1$-$G_n$).

The data driver 500 is connected to the data lines ($D_1$-$D_m$) of the liquid crystal panel assembly 300, selects a gray voltage from the gray voltage generator 800, and applies the selected gray voltage to the data lines ($D_1$-$D_m$) as a data voltage. In an exemplary embodiment, where the gray voltage generator 800 provides the predetermined number of gray voltages, the data driver 500 divides the gray voltages to generate a desired data voltage.

The signal controller 600 controls the gate driver 400 and the data driver 500. The signal controller 600 includes an image signal corrector 650.

In an exemplary embodiment, the driving devices (e.g., the gate driver 400, the data driver 500, the signal controller 600 and the gray voltage generator 800) may be directly mounted on the liquid crystal panel assembly 300 in an integrated circuit ("IC") chip type, may be mounted on a flexible printed circuit film (not illustrated) to be attached to the liquid crystal panel assembly 300 in a tape carrier package ("TCP") type, or mounted on a separate printed circuit board ("PCB") (not shown). In an alternative exemplary embodiment, the driving devices (400, 500, 600 and 800) may be integrated to the liquid crystal panel assembly 300 together with the signal lines ($G_1$-$G_n$, $D_1$-$D_m$) and the thin film transistor switch. In another alternative exemplary embodiment, the driving devices (400, 500, 600 and 800) may be integrated into a single chip. In such an embodiment, at least one of the driving devices or at least one of circuit elements configuring the driving devices may be disposed outside the single chip.

An operation of an exemplary embodiment of the liquid crystal display will now be described.

In an exemplary embodiment, as shown in FIG. 1, the signal controller 600 receives input image signals R, G and B and an input control signal for controlling expression of the input image signals R, G and B from an external graphic controller (not shown). The input image signals R, G and B include luminance information of each pixel (PX) and the luminance may have a predetermined number of grayscale levels, for example, 1024 ($=2^{10}$), 256 ($=2^8$), or 64 ($=2^6$) grayscale levels. In such an embodiment, the input control signal may include a vertical synchronization signal (Vsync), a horizontal synchronization signal (Hsync), a main clock signal (MCLK), a data enable signal (DE), a low frequency enable signal, and the like, for example.

The signal controller 600 processes the input image signals R, G and B based on the operating conditions of the display panel assembly 300 to generate correction image signal R', G' and B', generates a gate control signal (CONT1) and a data control signal (CONT2), outputs the gate control signal (CONT1) to the gate driver 400, and outputs the data control signal (CONT2) and the correction image signals R', G' and B' to the data driver 500. In an exemplary embodiment, the image signal corrector 650 of the signal controller 600 corrects the input image signals R, G and B in a predetermined manner to improve the afterimage of the liquid crystal panel assembly 300, which will be described later in detail.

The gate control signal (CONT1) includes an image scanning start signal to instruct a start of image scanning, and a clock signal for controlling an output period of the gate-on voltage. The gate control signal (CONT1) may further include an output enable signal for controlling duration of the gate-on voltage (Von) in the gate signal.

The data control signal (CONT2) includes a horizontal synchronization start signal for notifying a transmission start of a digital image signal to a pixel (PX) in each pixel row, a load signal for applying an analog data voltage to data lines ($D_1$-$D_m$), and a data clock signal. The data control signal (CONT2) may further include an inversion signal for inverting the polarity of a data voltage with respect to the common voltage (Vcom) (hereinafter, also referred to as a data voltage polarity).

According to the data control signal (CONT2) provided by the signal controller 600, the data driver 500 receives the correction image signals R', G' and B' for the pixel (PX) of a pixel row, selects a gray voltage that corresponds to the correction image signals R', G' and B' to convert the correction image signals R', G' and B' into an analog data voltage, and applies the analog data voltage to a corresponding data line of the data lines ($D_1$-$D_m$).

The gate driver 400 applies the gate-on voltage (Von) to the gate lines ($G_1$-$G_n$) based on the gate control signal (CONT1) provided by the signal controller 600 to turn on the switch connected to the gate lines ($G_1$-$G_n$). The data voltage applied to the data lines ($D_1$-$D_m$) is applied to the corresponding pixel (PX) through the turned-on switch.

A difference between the data voltage applied to the pixel (PX) and the common voltage (Vcom) is indicated as a charged voltage of the liquid crystal capacitor (Clc), that is, a pixel voltage. Liquid crystal molecules are differently arranged depending on the pixel voltage, and polarization of the light transmitting through the liquid crystal layer 3 is changed. The change of polarization is indicated as a change of light transmittance by a polarizer, and the pixel (PX) displays luminance indicated by the grayscale of the image signal.

By repeating the above-noted process for each one horizontal period (which is also written as a "1H" and which corresponds to one period of the horizontal synchronizing signal (Hsync) and the data enable signal (DE)), the gate-on voltage (Von) is sequentially applied to the gate lines ($G_1$-$G_n$) and the data voltage is applied to all pixels (PX) to thus display a one-frame image.

A state of the inversion signal ("frame inversion") applied to the data driver 500 is controlled so that a next frame may begin when one frame is finished, and a polarity of the data voltage applied to each pixel (PX) may be opposite to the polarity of the previous frame. In this instance, the polarity of the data voltage flowing through one data line may be changed periodically (e.g., a row inversion or a dot inversion) according to a characteristic of the inversion signal in one frame, or the polarity of the data voltage applied to one pixel row may be different (e.g., a column inversion or a dot inversion).

An exemplary embodiment of a method for correcting an image signal by an image signal corrector 650 of a signal controller 600 of a liquid crystal display, according to the invention, will now be described.

A kickback voltage (Vkb), which is changed based on a gray voltage and a polarity, will now be described.

In an exemplary embodiment of a liquid crystal display, the kickback voltage (Vkb) is expressed by the following Equation 1.

$$Vkb = \frac{Cgs}{(Clc + Cst + Cgs)}(Vg) \qquad \text{Equation 1}$$

In Equation 1, Cgs denotes parasitic capacitance between the gate electrode and the source electrode, Clc denotes liquid crystal capacitance, Cst denotes storage capacitance, and Vg denotes a gate voltage.

In such an embodiment, the liquid crystal capacitance Clc is expressed by the following Equation 2.

$$Clc = \varepsilon_0 \cdot \varepsilon \cdot \frac{A}{d} \qquad \text{Equation 2}$$

In Equation 2, $\in_0$ denotes a dielectric constant of a liquid crystal in a vacuum, $\in$ denotes a dielectric constant of the liquid crystal, d denotes a cell gap, and A denotes an overlapping area between a pixel electrode layer and a common electrode.

The liquid crystal capacitance (Clc) is changed by an alignment state of the liquid crystal due to a dielectric anisotropy of the liquid crystal. In one exemplary embodiment, for example, where the liquid crystal display is in a normally black mode, a liquid crystal dielectric constant (i.e., a horizontal dielectric constant, denoted by $\in\|$) in a black state is less than a liquid crystal dielectric constant (i.e., a vertical dielectric constant, denoted by $\in\perp$) in a white state. Therefore, in such an embodiment, the liquid crystal capacitance (Clc) in the white state is greater than the liquid crystal capacitance (Clc) in the black state, and the kickback voltage (Vkb) in the white state is less than the kickback voltage (Vkb) in the black state.

The liquid crystal capacitance (Clc) in the black state, which is influenced by the horizontal direction dielectric constant ($\in\|$), becomes less than the liquid crystal capacitance (CM in the white state, which is influenced by the vertical direction dielectric constant ($\in\perp$), and the kickback voltage (Vkb) in the black state becomes greater than the kickback voltage (Vkb) in the white state.

The kickback voltage (Vkb) is varied according to the grayscale corresponding thereto, such that the optimal common voltage (Vcom) defined by an arithmetic mean of a positive pixel voltage and a negative pixel voltage is thereby variable by the grayscale. The actual common voltage (Vcom) may be predetermined based on a test in the intermediate gray. The pixel voltage when a positive data voltage is applied and the pixel voltage when a negative data voltage is applied become different from each other because of a deviation between the optimal common voltage (Vcom) and the actual common voltage (Vcom) by the kickback voltage (Vkb), thereby generating a flicker and an afterimage.

Therefore, in an exemplary embodiment, the data voltages for respective grayscales may be applied in a compensation manner in consideration of the kickback voltage (Vkb) to compensate the common voltages (Vcom) for respective grayscales based on the kickback voltage (Vkb).

In an exemplary embodiment, when a difference between a sum of the positive voltage and the negative voltage, and the common voltage is defined as an offset value, a first offset value corresponding to a black grayscale, a second offset value corresponding to a white grayscale, and a third offset value corresponding to an intermediate grayscale satisfy the following Equation 1.

$$|\text{first offset value}-\text{second offset value}|\leq 50 \text{ millivolts (mV)}. \quad \text{Equation 1}$$

In an exemplary embodiment, the first offset value, the second offset value and the third offset value may further satisfy the following Equation 2. In such an embodiment, referring to Equation 2, the greater value of |third offset value−first offset value| and |third offset value−second offset value| may be greater than 20 mV.

$$\text{Max}(|\text{third offset value}-\text{first offset value}|,|\text{third offset value}-\text{second offset value}|)\geq 20 \text{ mV}. \quad \text{Equation 2}$$

In such an embodiment, the liquid crystal display that uses a plane to line switching ("PLS") mode and a photoalignment layer, as in the liquid crystal display described with reference to FIG. 3 and FIG. 4, may be driven based on the driving condition described above such that occurrence of a flicker and an afterimage may be effectively prevented. However, such a driving condition is not limited to a liquid crystal display in the PLS mode. In an alternative exemplary embodiment, a liquid crystal display in a coplanar electrode ("CE") mode such as an in-plane switching ("IPS") mode may be driven based on the driving condition described above.

Figure 5:
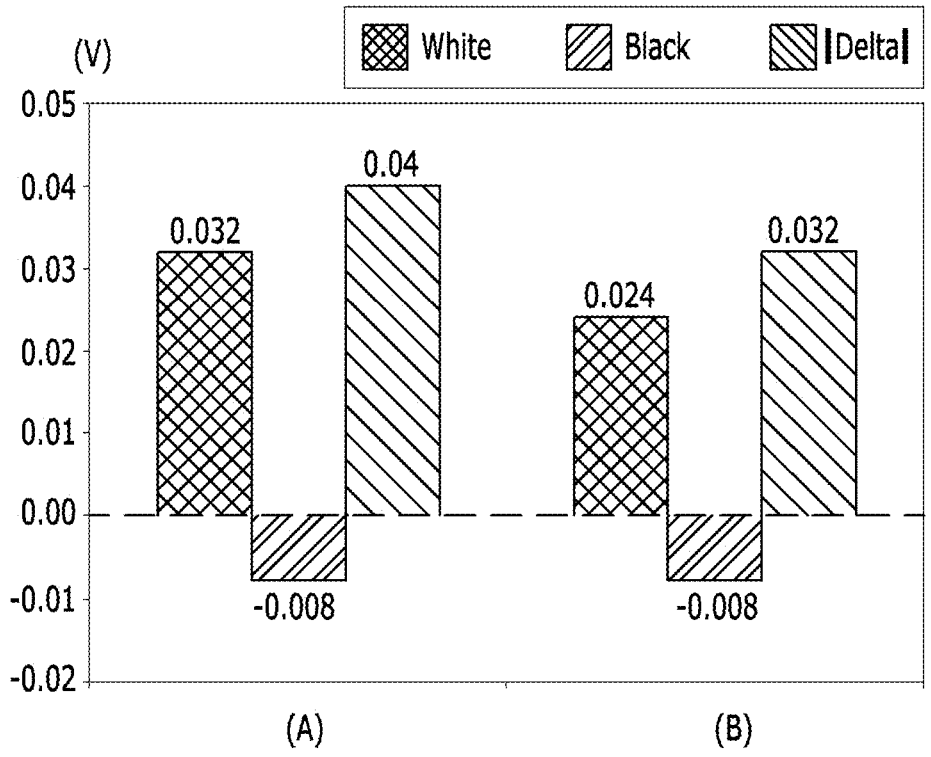
FIG. 5 PRIOR ART
FIG. 5 is a graph showing direct current ("DC") variations for afterimage application patterns in a conventional liquid crystal display.
Figure 6:
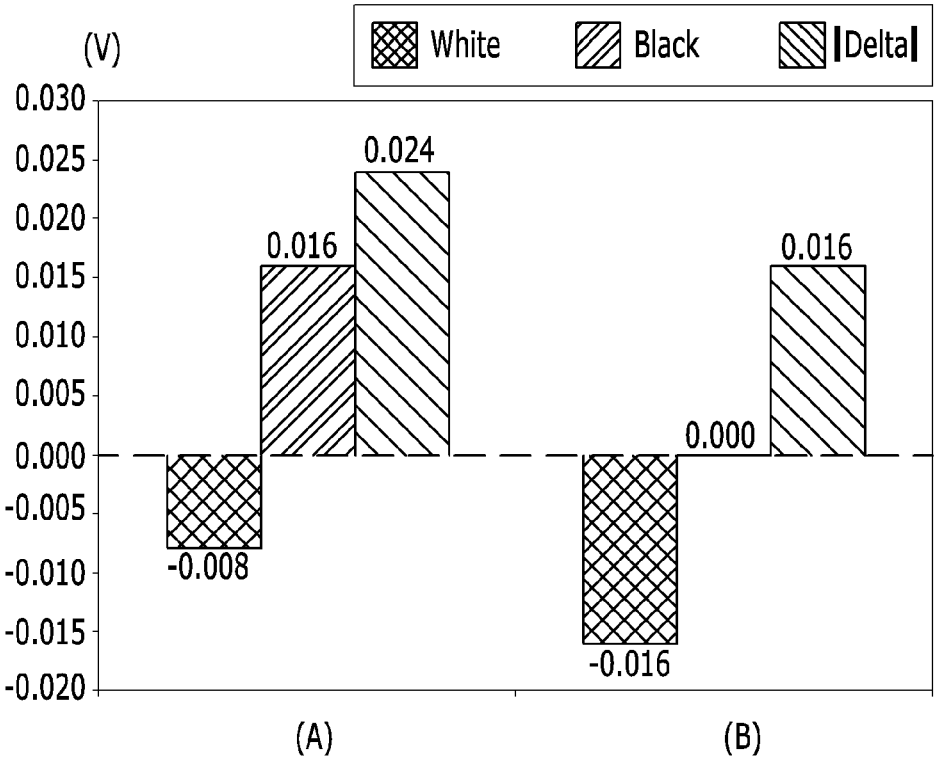
FIG. 6 is a graph showing DC variations for afterimage application patterns in an exemplary embodiment of a liquid crystal display, according to the invention.

Referring to FIG. 5 and FIG. 6, afterimage estimation on a conventional method for driving a liquid crystal display and afterimage estimation on an exemplary embodiment of a device and method for driving a liquid crystal display, according to the invention, will now be described.

FIG. 5 is a graph showing direct current ("DC") variations for afterimage application patterns in a conventional liquid crystal display. FIG. 6 is a graph showing DC variations for afterimage application patterns in an exemplary embodiment of a liquid crystal display, according to the invention.

To test an afterimage, a liquid crystal display having a PLS switching mode and using a photoalignment layer is used as in the liquid crystal display described with reference to FIG. 3 and FIG. 4.

Referring to FIG. 5, the data voltages for respective grayscales are controlled according to the kickback voltage (Vkb) to compensate the optimal common voltages (Vcom) for respective grayscales changeable by the kickback voltage (Vkb), and are then applied so that the optimal common voltages (Vcom) for respective grayscales may correspond to each other. Referring to FIG. 6, the above-described device and method for driving a liquid crystal display according to an exemplary embodiment of the invention are set to satisfy Equation 1 and Equation 2 described above. Referring to FIG. 5 and FIG. 6, a first DC variation (A) shows the afterimage estimation when the liquid crystal display is driven for an hour to display check patterns in the black state and the white state on the liquid crystal panel and then the liquid crystal display is driven to display the intermediate grayscale, and a second DC variation (B) shows the afterimage estimation when the check pattern is displayed for an hour, and then the liquid crystal display is driven to display the intermediate grayscale for five minutes.

Referring to FIG. 5 and FIG. 6, in an exemplary embodiment of the liquid crystal display according to the invention, the first DC variation (A) and the second DC variation (B) are reduced compared to the conventional liquid crystal display. The first offset value is defined as the value of [(positive data voltage corresponding to (i.e., to display) the black grayscale, e.g., grayscale level is 0)+(negative data voltage corresponding to the black grayscale)−common voltage]. The second offset value is defined as the value of [(positive data voltage corresponding to (i.e., to display) the white grayscale, e.g., grayscale level is 255)+(negative data voltage corresponding to the white grayscale)−common voltage]. The first offset value is defined as the value of [(positive data voltage corresponding to (i.e., to display) the black grayscale, e.g., grayscale level is 0)+(negative data voltage corresponding to the black grayscale)−common voltage]. The second offset value is defined as the value of [(positive data voltage corresponding to (i.e., to display) the white grayscale, e.g., grayscale level is 255)+(negative data voltage corresponding to the white grayscale)−common voltage].

Figure 8:
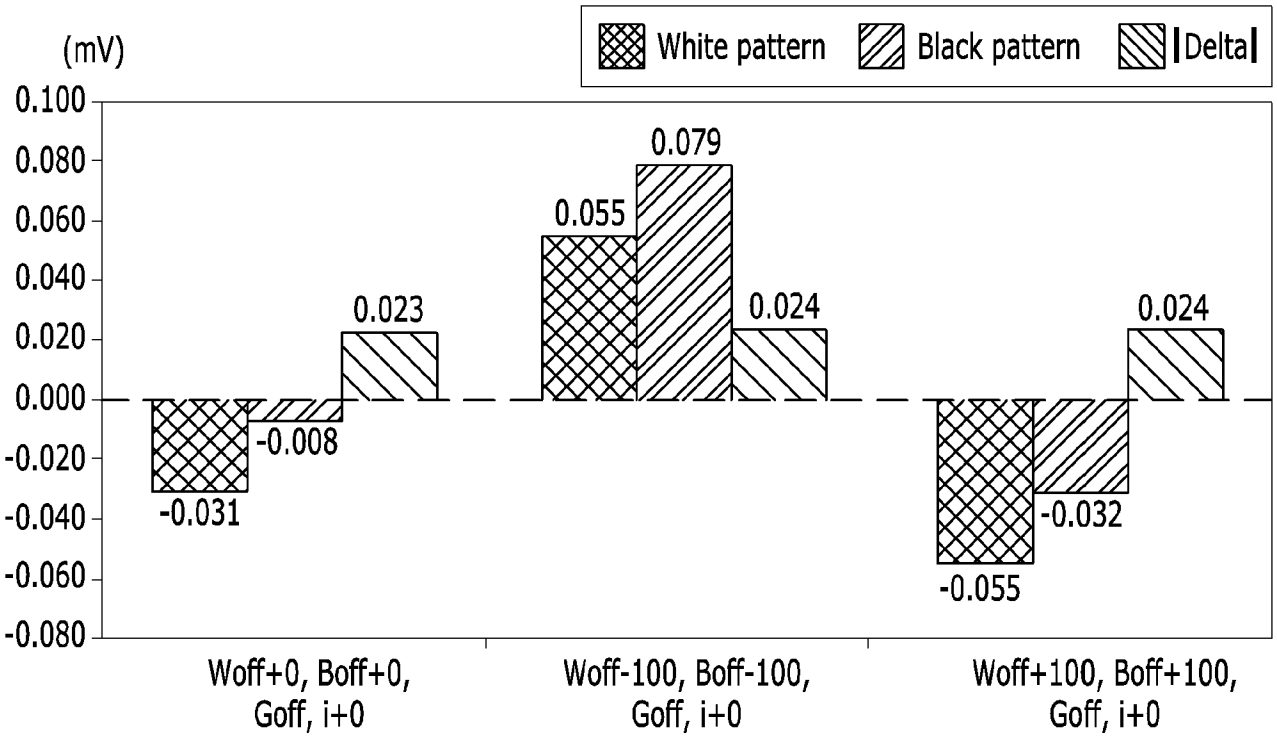
FIG. 8 is a graph showing a DC charged amount in a predetermined driving condition of FIG. 7.

Referring to FIG. 7 and FIG. 8, optimal amounts of the first offset value that corresponds to the black grayscale and the second offset value that corresponds to the white grayscale will now be described.

FIG. 7 is a table showing afterimage estimation performed under various conditions for driving a liquid crystal display. FIG. 8 is a graph showing a DC charged amount in a predetermined driving condition of FIG. 7.

FIG. 7 shows the estimation method of FIGS. 5 and 6 in detail, where the first offset value (Boff) is controlled to be −100 mV, −50 mV, zero (0) mV, 5 mV, 10 mV, 20 mV, 50 mV and 100 mV, the second offset value (Woff) is controlled to be −100 mV, −50 mV, zero (0) mV, 20 mV, 50 mV and 100 mV, and the third offset value (Goff) is controlled to be zero (0) mV.

Referring to FIG. 7, when absolute values of the first offset value and the second offset value are the same (case 1), an afterimage degree which is viewed with eyes of a user after an hour of driving is about 3.5, and when the absolute values of the first offset value and the second offset value are different (case 2), the afterimage degree is about 3.5 to about 4. When a difference of the absolute values between the first offset value and the second offset value is 5 mV or 10 mV (case 3), the afterimage degree is about 3 to about 3.5.

Here, the afterimage degree observed by human eyes may be expressed as zero (0) when the afterimage is invisible, as 1 to 2 when the afterimage is weak and recognizable by an expert viewer, as 3 when the afterimage is weakly visible by an ordinary user, and as 4 when the afterimage is strongly visible by the ordinary user.

Referring to FIG. 8, a DC charged amount is measured from case 1 described with reference to FIG. 7, and when the absolute values of the first offset value and the second offset value are set to be the same as each other, it is found that there is no substantial difference of the DC charged amounts.

Figure 10:
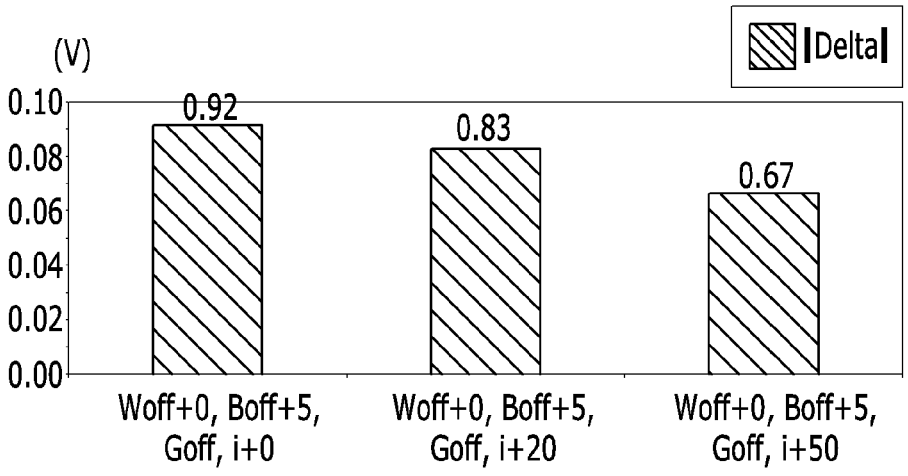
FIG. 10 is a graph showing a DC charged amount in a predetermined driving condition of FIG. 9.

Referring to FIG. 9 and FIG. 10, optimized amounts of the third offset value that corresponds to the intermediate grayscale, the first offset value that corresponds to the black grayscale, and the second offset value that corresponds to the white grayscale will now be described.

FIG. 9 is a table showing afterimage estimation performed under a predetermined condition for driving a liquid crystal display. FIG. 10 is a graph showing a DC charged amount in the predetermined driving condition of FIG. 9.

FIG. 9 shows an estimation method of FIGS. 5 and 6 in detail, where the first offset value (Boff) is controlled to be zero (0) mV, 5 mV and 50 mV, the second offset value (Woff) is controlled to be zero (0) mV and 50 mV, and the third offset value (Goff) is controlled to be −50 mV, −20 mV, zero (0) mV, 20 mV and 50 mV.

Referring to FIG. 9, when a difference between the absolute value of the greater one of the first offset value and the second offset value and the third offset value is controlled as zero (0) mV, 15 mV, 25 mV, 45 mV, and 55 mV (case 4), the afterimage degree when it is observed by human eyes after an hour of driving is about 3, and when a difference between the absolute value of the greater one of the first offset value and the second offset value and the third offset value is controlled as zero (0) mV (case 5), the afterimage degree is about 3.5. Here, the difference between the first offset value and the second offset value in case 4 and case 5 are substantially constant, and there is no substantial difference of the afterimage degree when it is observed with human eyes after an hour of driving.

However, there is a substantially difference when the liquid crystal display is driven for about five minutes to express the intermediate grayscale after an hour of driving for displaying a check pattern in the black state and the white state to the liquid crystal panel and the afterimage is estimated. That is, when a difference between the absolute value of the greater one of the first offset value and the second offset value and the third offset value is 5 mV, the afterimage degree is about 3, when the difference is 15 mV and 25 mV, the afterimage degree is about 2.5, and when the difference is 45 mV and 55 mV, the afterimage degree is about 2. Further, case 5 in the afterimage estimation after five minutes of driving generates the afterimage of degree of about 3.5.

Referring to FIG. 10, showing the DC charged amount measured from case 4 described with reference to FIG. 9, it is found that the DC charged amount is reduced as the difference between the absolute value of the greater one of the first offset value and the second offset value, and the third offset value increases.

FIG. 11 is a table showing afterimage estimation in a liquid crystal display driven by an exemplary embodiment of a device and a method for driving according to the invention.

Referring to FIG. 11, the first offset value is set to be about 5 mV, the second offset value is set to be about zero (0) mV, and the third offset value is set to be about 50 mV, and the afterimage of the liquid crystal panel using a photoalignment layer in the PLS mode is estimated for respective grayscales.

As shown in FIG. 11, the afterimage degrees observed with human eyes are less than about 2 from the grayscales that are measured in FIG. 11.

While the invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A device for driving a liquid crystal display, in which a pixel voltage is reduced by a kickback voltage variable according to a grayscale, the device comprising:

a signal controller configured to receive an input image signal corresponding to the grayscale from outside;

an image signal corrector configured to correct the input image signal and generate a data input signal based on the corrected input image signal; and a data driver configured to supply a data voltage corresponding to the grayscale based on the data input signal, wherein the grayscale comprises a black grayscale, a white grayscale, and an intermediate grayscale between the black grayscale and the white grayscale, the data voltage comprises a positive voltage and a negative voltage, and when a difference between a sum of the positive voltage and the negative voltage, and a common voltage, is defined as an offset value, a first offset value corresponding to the black grayscale, a second offset value corresponding to the white grayscale and a third offset value corresponding to the intermediate grayscale satisfy the following inequation:

$$|\text{first offset value}-\text{second offset value}|\leq 50 \text{ millivolts.}$$

2. The device of claim 1, wherein the first offset value corresponding to the black grayscale, the second offset value corresponding to the white grayscale and the third offset value corresponding to the intermediate grayscale satisfy the following inequation:

$$\text{Max}(|\text{third offset value}-\text{first offset value}|,|\text{third offset value}-\text{second offset value}|)\geq 20 \text{ millivolts.}$$

3. The device of claim 2, wherein the liquid crystal display comprises:

a first substrate;

a thin film transistor disposed on the first substrate;

a first electrode connected to the thin film transistor; and a first alignment layer disposed on the first electrode, wherein the first alignment layer comprises a copolymer of at least one of a cyclobutane dianhydride and a cyclobutane dianhydride derivative.

4. The device of claim 3, wherein the cyclobutane dianhydride is expressed as Formula (A), and the cyclobutane dianhydride derivative is expressed as Formula (B):

Formula (A)

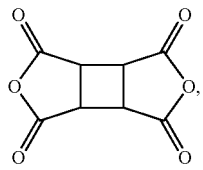

Formula (B)

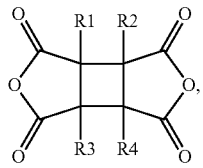

wherein, in Formula (B), R1, R2, R3 and R4 are each independently hydrogen or an organic compound, and at least one of R1, R2, R3 and R4 is not hydrogen.

5. The device of claim 4, wherein the liquid crystal display further comprises:

a second electrode disposed on the first substrate; and an insulating layer disposed between the first electrode and the second electrode, wherein the first electrode comprises a plurality of branch electrodes, and the second electrode has a planar shape.

6. The device of claim 5, wherein the plurality of branch electrodes overlaps the second electrode having the planar shape.

7. The device of claim 6, wherein the liquid crystal display further comprises a passivation layer disposed between the thin film transistor and the second electrode, and the thin film transistor is connected to the first electrode through a contact hole defined through the passivation layer and the insulating layer.

8. A method for driving a liquid crystal display, in which a pixel voltage is reduced by a kickback voltage variable according to a grayscale, the method comprising:

receiving an input image signal from an outside; and correcting the input image signal and generating a data input signal based on the corrected input image signal, wherein a data voltage corresponding to the grayscale comprises a black data voltage corresponding to a black grayscale, a white data voltage corresponding to a white grayscale, and an intermediate data voltage corresponding to an intermediate grayscale between the black grayscale and the white grayscale, the data voltage further comprises a positive voltage and a negative voltage, and when a difference between a sum of the positive voltage and the negative voltage, and a common voltage, is defined as an offset value, a first offset value corresponding to the black grayscale, a second offset value corresponding to the white grayscale, and a third offset value corresponding to the intermediate grayscale satisfy the following inequation:

$$|\text{first offset value}-\text{second offset value}|\leq 50 \text{ millivolts.}$$

9. The method of claim 8, wherein the first offset value corresponding to the black grayscale, the second offset value corresponding to the white grayscale, and the third offset value corresponding to the intermediate grayscale satisfy the following inequation:

$$\text{Max}(|\text{third offset value}-\text{first offset value}|,|\text{third offset value}-\text{second offset value}|)\geq 20 \text{ millivolts.}$$

10. The method of claim 9, wherein the liquid crystal display comprises:

a first substrate;

a thin film transistor disposed on the first substrate;

a first electrode connected to the thin film transistor; and a first alignment layer disposed on the first electrode, wherein the first alignment layer comprises copolymer of at least one of a cyclobutane dianhydride and a cyclobutane dianhydride derivative.

11. The method of claim 10, wherein the copolymer of the first alignment layer is formed by copolymerizing at least one of a cyclobutane dianhydride expressed as Formula (A) and a cyclobutane dianhydride derivative expressed as Formula (B):

Formula (A)

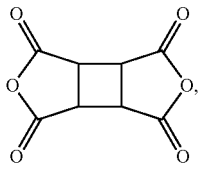

Formula (B)

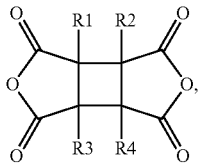

wherein, in Formula (B), R1, R2, R3 and R4 are each independently hydrogen or an organic compound, and at least one of R1, R2, R3 and R4 is not hydrogen.

12. The method of claim 11, wherein the liquid crystal display further comprises:

a second electrode disposed on the first substrate, and an insulating layer disposed between the first electrode and the second electrode, wherein the first electrode comprises a plurality of branch electrodes, and the second electrode has a planar shape.

13. The method of claim 12, wherein the plurality of branch electrodes overlaps the second electrode having the planar shape.

14. The method of claim 13, wherein the liquid crystal display further comprises a passivation layer disposed between the thin film transistor and the second electrode, and the thin film transistor is connected to the first electrode through a contact hole defined through the passivation layer and the insulating layer.

* * * * *